US005925238A

United States Patent [19]

Duddy et al.

[11] Patent Number: 5,925,238

[45] Date of Patent: Jul. 20, 1999

[54] CATALYTIC MULTI-STAGE HYDRODESULFURIZATION OF METALS-CONTAINING PETROLEUM RESIDUA WITH CASCADING OF REJUVENATED CATALYST

[75] Inventors: John E. Duddy, Bensalem, Pa.; Lawrence M. Abrams, Cherry Hill; Steven J. Hildebrandt, Kendall Park, both of N.J.

[73] Assignee: IFP North America, Princeton, N.J.

[21] Appl. No.: 08/853,393

[22] Filed: May 9, 1997

Related U.S. Application Data

[51] Int. Cl.[6] ..... C10G 65/04

[52] U.S. Cl. ..... 208/210; 208/216 R; 208/251 H; 208/213

[58] Field of Search ..... 208/210, 251 H, 208/216 R

[56] References Cited

U.S. PATENT DOCUMENTS

| | | | |
|---|---|---|---|
| 3,705,844 | 12/1972 | Alpert | 208/210 |
| 3,795,607 | 3/1974 | Adams et al. | 208/210 |
| 3,900,390 | 8/1975 | Adams | 208/210 |
| 3,926,784 | 12/1975 | Christman et al. | 208/210 |
| 3,964,995 | 6/1976 | Wolke et al. | 208/210 |

*Primary Examiner*—Helane Myers
*Attorney, Agent, or Firm*—John F. Ritter; Fred A. Wilson

[57] ABSTRACT

A process for catalytic two-stage hydrodesulfurization of metal-containing petroleum residua feedstocks to achieve at least about 75% desulfurization of the liquid product while also providing at least about 40% reduction in catalyst consumption. In the process, used catalyst having a catalyst equilibrium age of 0.3–5.0 bbl oil feed/lb catalyst is withdrawn from the second stage reactor, rejuvenated so as to remove 10–50 wt. % of the contaminant metals and at least 80 wt. % of carbon deposited on the catalyst, and then cascaded forward and added to the first stage reactor. Sufficient fresh make-up catalyst is added to the second stage reactor to replace the used catalyst withdrawn there, and only sufficient fresh catalyst is added to the first stage reactor to replace any catalyst transfer losses. Used catalyst having a catalyst equilibrium age of 0.6 to 10.0 bbl. oil per lb. catalyst is withdrawn from the first stage reactor for discard.

10 Claims, 3 Drawing Sheets

CATALYTIC MULTI-STAGE HYDRODESULFURIZATION OF METALS-CONTAINING PETROLEUM RESIDUA WITH CASCADING OF REJUVENATED CATALYST

BACKGROUND OF INVENTION

This invention pertains to catalytic multi-stage hydrodesulfurization of metals-containing petroleum residua feedstocks. It pertains particularly to a process for deep hydrodesulfurization of such feedstocks which utilizes in the first stage catalytic reactor used particulate catalyst withdrawn from the second stage reactor and rejuvenated, so as to reduce overall fresh catalyst consumption for the process.

Some usage of regenerated catalysts in catalytic hydroconversion of hydrocarbon feedstocks is generally known. For example, U.S. Pat. No. 3,893,911 to Rovesti et al discloses a multi-stage catalytic ebullated bed demetallization process for petroleum feedstocks in which used catalyst in the first stage reactor is withdrawn and treated to remove carbon deposits without any removal of contaminant metals, then returned to the first stage reactor for reuse. However, because such treated catalyst becomes further contaminated with additional metals deposits, the process requires high catalyst replacement rates and provides undesirably low levels of hydrodesulfurization activity. U.S. Pat. No. 4,576,710 to Nongbri et al discloses a catalytic desulfurization process in which used catalyst from ebullated bed reactors is withdrawn and treated for carbon removal only, including minor transfer of second stage used but untreated catalyst to the first stage reactor. However, the process is not suitable for deep desulfurization of high metals-containing petroleum feedstocks, because without contaminant metals removal from the used catalyst, increased metals loadings on the treated catalyst results in low catalytic activity and undesirably high catalyst consumption for the process.

Some rejuvenation methods for used particulate catalysts to remove contaminant metals and carbon are also known. For example, U.S. Pat. Nos. 4,454,240 and 4,595,600 to Ganguli each describe a process for treating used catalysts withdrawn from hydroconversion reactors for hydrocarbon feedstreams so as to remove contaminant metals and carbon from the used catalyst. Also, U.S. Pat. No. 4,769,219 to Tasker et al discloses an apparatus and method for treating particulate used catalyst in a single vessel to remove heavy oils, contaminant metals, and coke deposits from the catalyst and provide a rejuvenated catalyst material suitable for further use.

However, these known processes for catalytic hydroprocessing of petroleum residua feedstocks do not adequately address the problem of high contaminant metals loading and resulting low catalytic activity in the first stage reactor for desulfurization of high metals-containing petroleum residua feeds. Thus, further process improvements are desirable, particularly for deep hydrodesulfurization of high metals-containing petroleum residua feedstocks to obtain desulfurized hydrocarbon liquid products while achieving reduced overall catalyst usage. Such process improvements can be achieved by adding rejuvenated second stage catalyst to the first stage reactor, so that the first stage reactor catalyst has reduced contaminant metals loading and has catalytic activity which is close to that of fresh catalyst.

SUMMARY OF INVENTION

This invention provides an improved process for catalytic multi-stage hydrodesulfurization and hydrodemetallization of metals-containing petroleum residua feedstocks to produce desired lower boiling hydrocarbon liquid products, by using multi-staged catalytic ebullated-bed reactors in combination with specific catalyst withdrawal, rejuvenation and reuse procedures. In this improved process, petroleum residua feedstocks containing at least about 2 wt. % sulfur and up to about 6 wt. % sulfur and 100–1,600 wppm total metals, are processed in multi-staged catalytic ebullated bed reactors connected in series to obtain high levels of hydrodesulfurization, such as exceeding about 75 wt. % hydrodesulfurization of the feedstock. The process includes introducing the feedstock together with hydrogen into the first stage reactor containing an ebullated catalyst bed which is maintained at 650–850° F. temperature, 1,000–3,500 psig hydrogen partial pressure and space velocity of 0.2–2.0 vol. feed/hr/vol reactor ($V_f/Hr/V_r$) for initial catalytic reaction therein to provide at least about 55% desulfurization of the feed. The partially converted effluent material is passed on to a second stage catalytic reactor maintained at similar reaction conditions for further hydroconversion and hydrodesulfurization reactions therein.

The second stage reactor effluent material is passed to gas/liquid separation and distillation steps, from which hydrocarbon liquid product and distillation vacuum bottoms fraction materials are removed. The vacuum bottoms material boiling above at least 850° F. temperature and preferably above 900° F. may be recycled back to the first stage catalytic reactor inlet at a volume ratio to the fresh feedstock of 0.2–1.5/1, and preferably at 0.5–1.0/1 recycle ratio for further hydroconversion and possible extinction reactions therein.

According to this invention, used catalyst having catalyst equilibrium age of 0.3–5.0 bbl oil processed per pound catalyst contained in the second stage reactor is withdrawn from the reactor and treated using suitable catalyst rejuvenation procedures to remove about 10–50 wt. % of the contaminant metals and usually also to remove at least about 80 wt. % of the carbon deposits from the used catalyst. Such used catalyst withdrawn from the second stage reactor is treated by suitable solvent washing and acid treatment steps so as to restore at least about 85% and preferably 90–100% of the original catalyst pore volume, surface area and catalytic activity characteristics. This rejuvenated particulate catalyst from the second stage reactor is then cascaded forward and added to the first stage reactor, together with any fresh make-up catalyst as needed therein. Sufficient used catalyst is withdrawn from the first stage reactor to maintain an equilibrium catalyst age therein exceeding that in the second stage reactor, with the first stage reactor catalyst equilibrium age usually being 0.6–10.0 bbl. oil processed per pound catalyst in the reactor. Sufficient fresh particulate catalyst is added to the second stage reactor to replace the used catalyst withdrawal therefrom for rejuvenation.

This invention is useful for particulate supported type catalysts having various shapes such as beads or extrudates and having size range of 0.030–0.125 inch (0.7–3.2 mm) effective diameter. The catalysts compositions utilized by this invention may contain 2–25 wt. percent total active metals selected from the group consisting of cadmium, chromium, cobalt, iron, molybdenum, nickel, tin, tungsten, and mixtures thereof deposited on a support material selected from the group of alumina, silica, titania and combinations thereof. Also, catalysts having the same characteristics may be used in both the first stage and second stage reactors. The particulate catalyst will usually have the following useful and preferred characteristics:

| | Useful | Preferred |
|---|---|---|
| Particle Diameter, in. | 0.025–0.083 | 0.030–0.065 |
| Particle Diameter, mm | 0.63–2.1 | 0.75–1.65 |
| Bulk Density, lb/ft$^3$ | 25–50 | 30–45 |
| Particle Crush Strength, lb/mm | 1.8 min | 2.0 min. |
| Total Active Metals Content, Wt. % | 2–25 | 5–20 |
| Total Pore Volume, cm$^3$gm* | 0.30–1.50 | 0.50–1.20 |
| Surface Area, m$^2$/gm | 100–400 | 150–350 |
| Average Pore Diameter, Angstrom** | 50–350 | 100–250 |

*Determined by mercury penetration method at 60,000 psi.
**Average pore diameter calculated by $$APD = \frac{4\ \text{Pore Volume}}{\text{Surface Area}} \times 10^4$$

Catalysts having unimodal, bimodal and trimodal pore size distribution are useful in this process. Preferred catalysts should contain 5–20 wt. % total active metals consisting of combinations of cobalt, molybdenum and nickel deposited on alumina or modified alumina support material.

This invention advantageously provides a process for deep hydrodesulfurization and demetallization of metals-containing petroleum residua feedstocks, and also provides reduced fresh particulate catalyst make-up costs and reduced spent catalyst disposal costs. As a result of this process and its used catalyst withdrawal and rejuvenation procedures, the required addition of fresh catalyst to the first stage reactor is reduced at least by 40% and up to 100% of that otherwise required without using any spent catalyst rejuvenation procedures. Also, overall catalyst usage for the process is reduced by 20 to 50%, thereby resulting in significant reduction in the quantity of fresh catalyst to be added and spent catalyst to be disposed, which provides significant improvement to process economics. This process also advantageously eliminates any concerns with respect to the effect of multiple rejuvenation and/or regeneration cycles on catalyst properties that would be present if the treated catalyst was returned to the same stage reactor from which it was removed.

DESCRIPTION OF INVENTION

Figure 1:
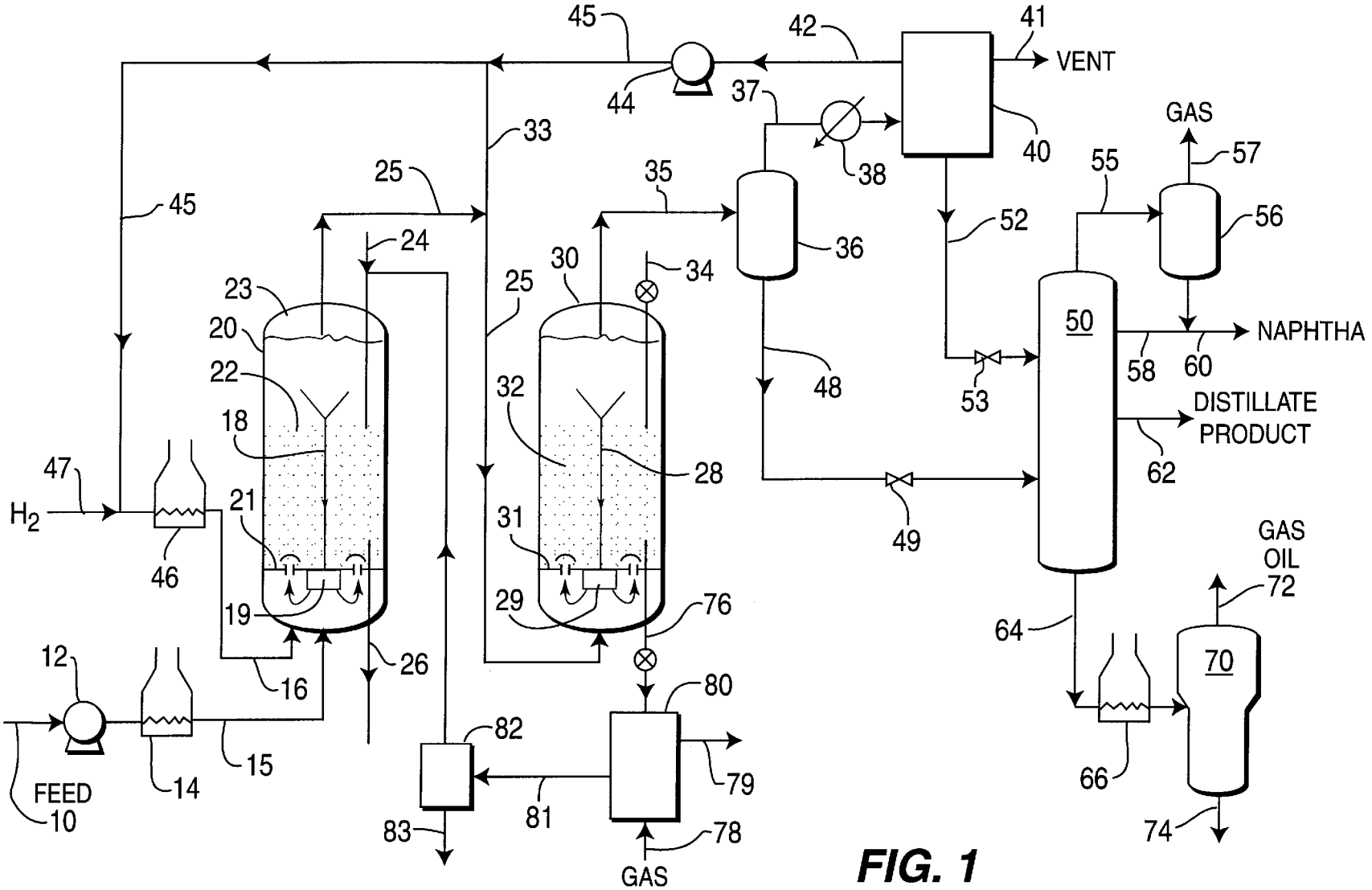
FIG. 1 is a schematic flow diagram of a catalytic two-stage process for hydrodesulfurization of metals-containing feedstocks to produce lower boiling hydrocarbon liquid products, including rejuvenation of used particulate catalyst withdrawn from the second stage reactor and rejuvenated before being added to the first stage reactor for further use therein.
Figure 2:
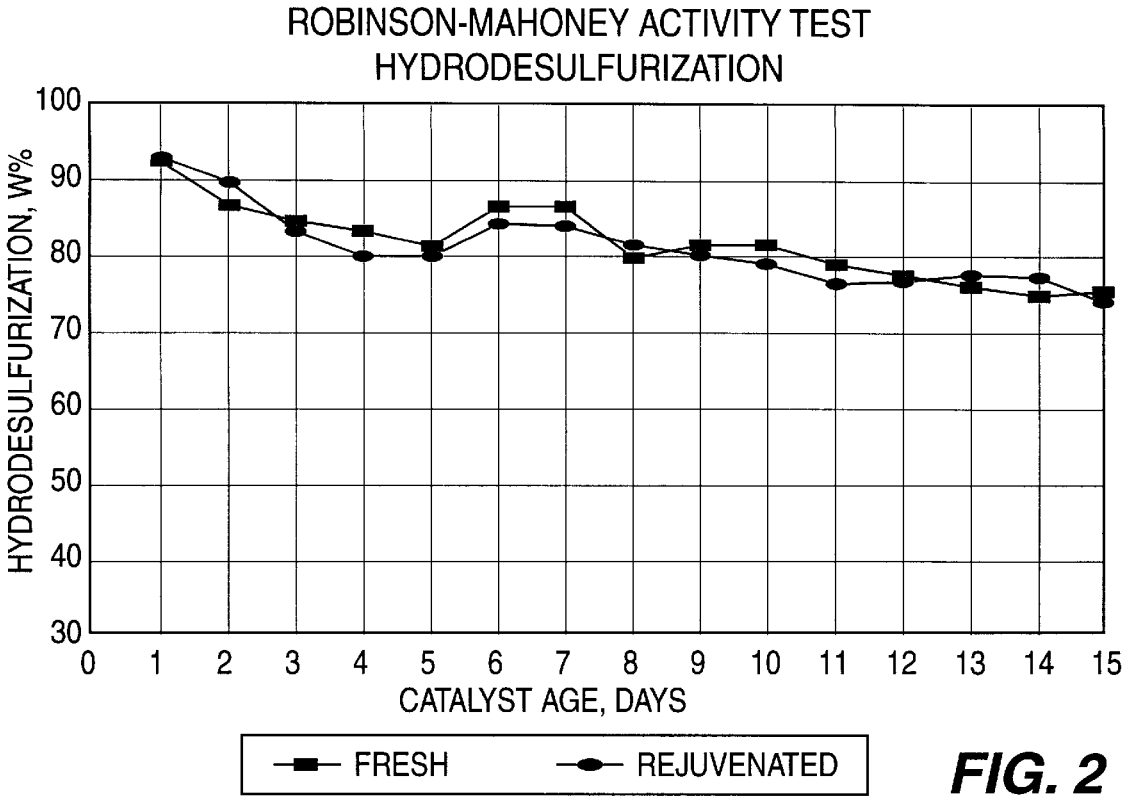
FIGS. 2–5 are graphs showing a comparison of catalytic activity for fresh catalyst vs. rejuvenated catalyst in a first stage reactor of a catalytic two-stage reactor system for providing high percentage hydrodesulfurization, vanadium metal removal, 975° F.$^+$ fraction hydroconversion, and Conradson carbon residue conversion, respectively, for a typical petroleum residua feedstock containing high concentrations of sulfur, metals and Conradson carbon residue.
Figure 3:
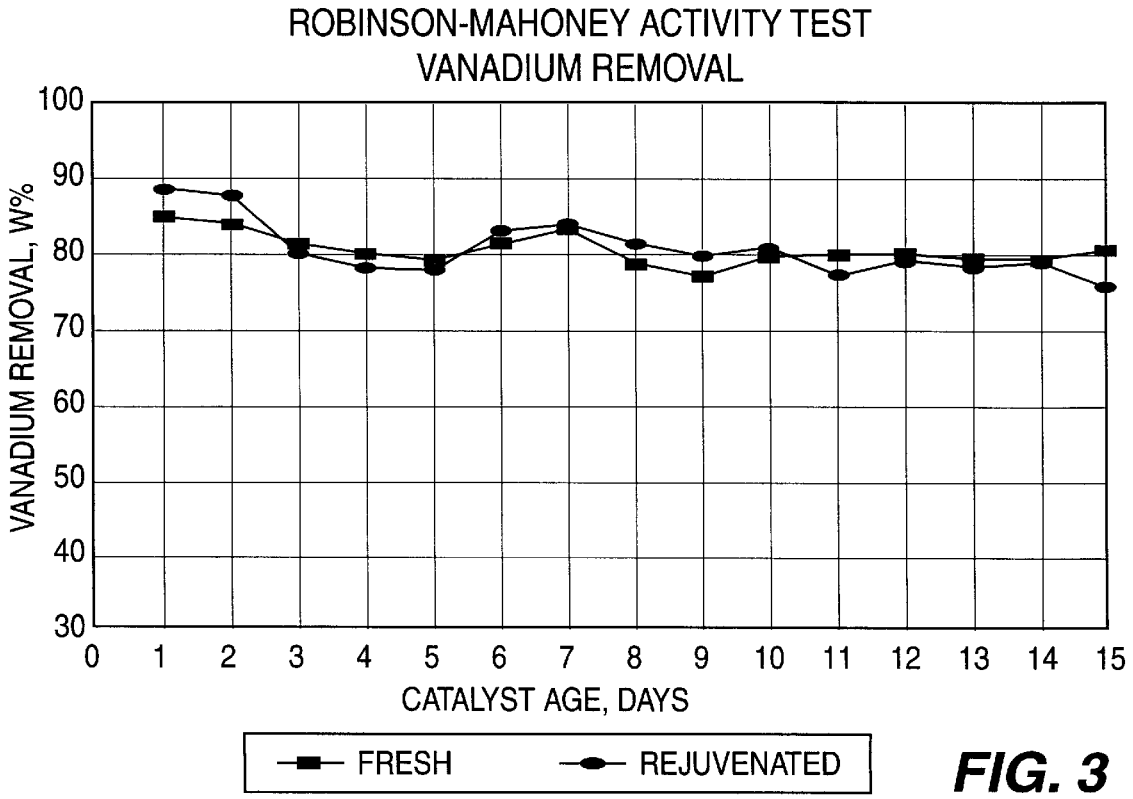
Figure 4:
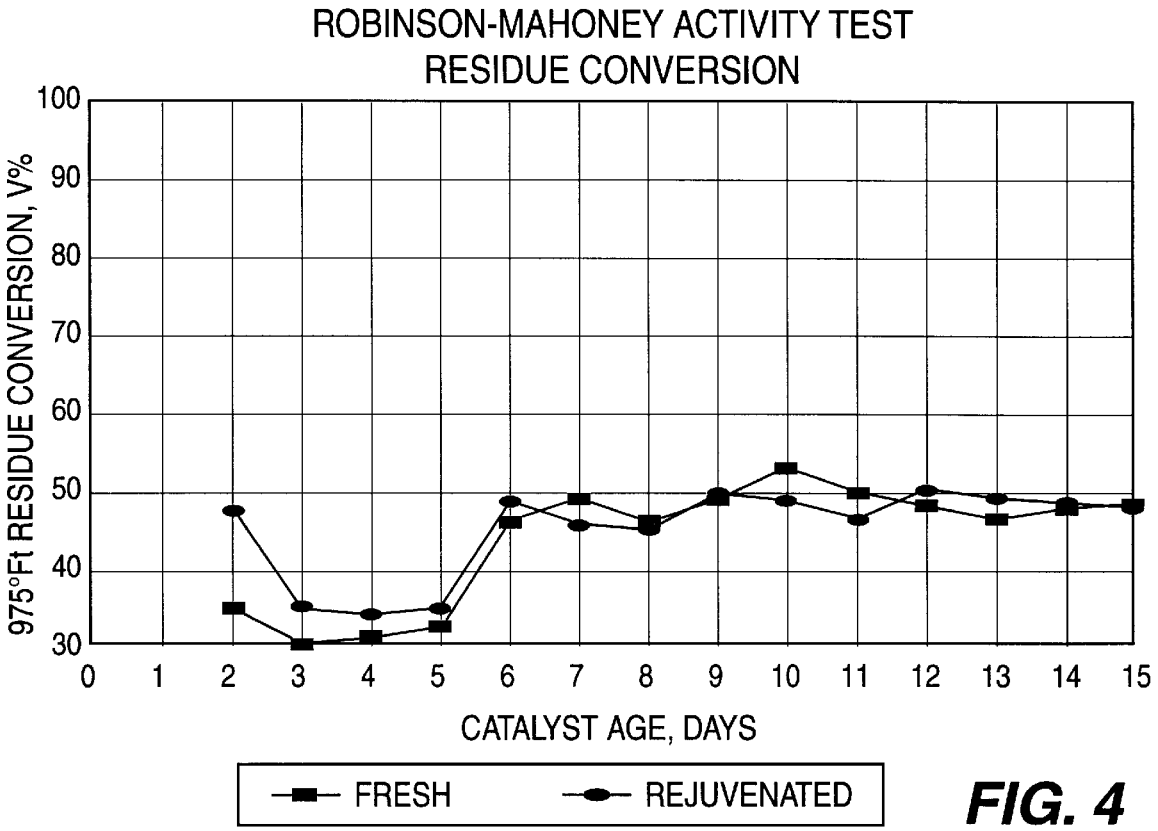
Figure 5:
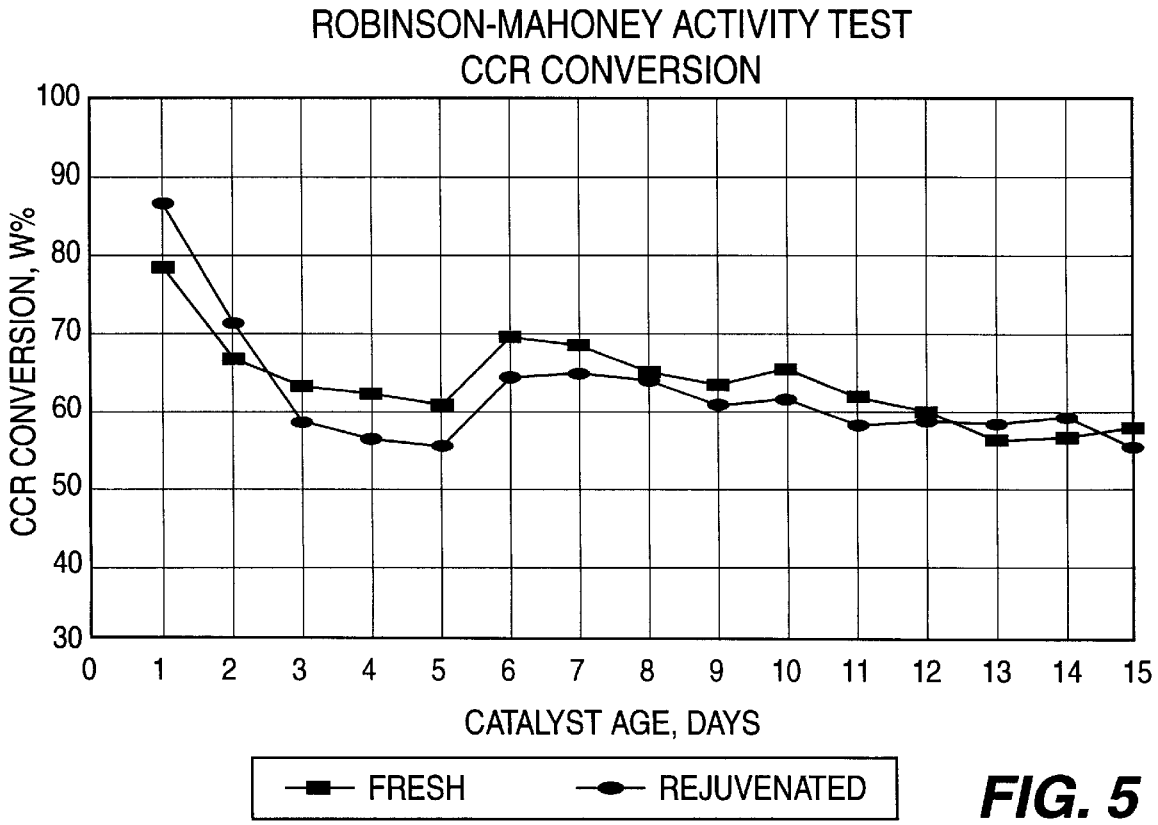

As shown by the FIG. 1 flow diagram for this improved catalytic hydrodesulfurization process for metals-containing petroleum residua feedstocks, two catalytic ebullated bed reactors connected in series are used to obtain deep hydrodesulfurization of the residua feedstocks, i.e. at least about 80% desulfurization of the feedstock. A heavy petroleum residua feedstock such as Maya/isthmus or Ural vacuum bottoms fraction containing 2–6 wt. % sulfur together with 100–1,600 wppm total metals is provided at 10, pressurized by pump 12 and preheated at 14 to about 500° F. The heated feedstock at 15 is then introduced together with hydrogen at 16 into reactor 20 containing ebullated catalyst bed 22. The reactor 20 contains a flow distributor and catalyst support grid 21, so that the upflowing feed liquid and hydrogen gas will expand the catalyst bed 22 to a height which is 10–40% above its settled height, and place the catalyst particles in random motion in the liquid.

Catalysts useful in this invention should have particle size between 0.030–0.125 inch (0.7–3.2 mm) effective diameter. Useful hydrodesulfurization catalysts contain 2–25 weight % of catalytic metal selected from the group consisting of cobalt, molybdenum, nickel, tungsten, and mixtures thereof, deposited on a support material selected from the group of alumina, silica, titania and mixtures thereof.

In the reactor 20, recycle of reactor liquid from above the expanded bed 22 through downcomer conduit 18 and recycle pump 19 to below the flow distributor 21 is usually needed to provide sufficient upflowing liquid velocity in the catalyst bed 22 to expand the bed and maintain the catalyst in random motion and assure good catalyst/oil contact. For the petroleum residua feedstocks of this invention, useful reactions conditions in the reactor 20 are 650–850° F. (343–455° C.) temperature, 1,000–3,500 psig hydrogen partial pressure, and liquid space velocity of 0.20–2.0 $V_f$/hr/$V_r$ (volume feed per hour per volume of reactor). Preferred reaction conditions are 750–830° F. (400–443° C.) temperature, 1,500–3,000 psig hydrogen partial pressure and space velocity of 0.40–1.5 $V_f$/hr/$V_r$.

From the catalyst reactor 20, an effluent stream containing a mixture of gas and liquid fractions is withdrawn at 25, and passed to second stage catalytic reactor 30. The operation of this second-stage reactor 30 is quite similar to that of first stage reactor 20, however slightly higher temperature in the range of 650–850° F. (343–455° C.) can be used if desired. Catalyst bed 32 in reactor 30 is expanded by recycle of reactor liquid from above the bed downward through conduit 28 by pump 29 and upward through flow distribution 31. Recycle hydrogen provided at 33 is added to reactor effluent stream 25 to quench and cool the stream upstream of the second stage reactor 30. Fresh particulate catalyst is added to reactor bed 32 at connection 34 as needed.

From reactor 30, effluent stream 35 containing gaseous and liquid fractions is removed and passed to hot separator 36 for phase separation. The resulting gaseous portion 37, which is principally hydrogen, is cooled at heat exchanger 38, and the hydrogen is recovered in gas purification step 40. A vent gas containing $H_2S$, $CO_2$ and water vapor is removed at 41. Recovered hydrogen at 42 is recycled by compressor 44 through conduit 45 to the second stage reactor 30, and also reheated at heater 46, and passed together with make-up hydrogen at 47 as needed to provide the heated hydrogen stream 16 to the bottom of first stage reactor 20.

From phase separator 36, a liquid fraction 48 is withdrawn, pressure-reduced at 49 to a pressure below about 200 psig, and passed to fractionation step 50. A condensed vapor stream is also withdrawn at 52 from the gas purification step 40, pressure-reduced at 53 and passed to the fractionation step 50, from which is withdrawn a low pressure gas stream 55. This gas stream 55 is phase separated at separator 56 to provide low pressure gas stream 57 and liquid stream 58 to provide reflux liquid to the fractionator 50, and a remaining naphtha product stream 60. A middle boiling range distillate liquid product stream is withdrawn at 62, and a heavy hydrocarbon liquid stream is withdrawn at 64.

From the fractionator 50, the heavy oil stream 64 usually having normal boiling temperature above about 650° F.$^+$ is withdrawn, reheated as needed in heater 66 and passed to vacuum distillation step 70. A vacuum gas oil product stream is withdrawn overhead at 72, and vacuum bottoms product stream is withdrawn at 74 for further processing.

According to the present invention, used particulate catalyst is withdrawn from ebullated bed 32 in second stage reactor 30 at conduit 76 and is passed to a catalyst rejuvenation step at 80. In unit 80, the used catalyst is processed so as to remove substantially all oil and much of the contaminant metals and carbon deposits on the catalyst using steps of solvent washing and acid treatment of the catalyst. Following the contaminant metal removal step, a combustion gas containing 1–6 vol % oxygen with the remainder being inert gas such as nitrogen is introduced into the rejuvenation unit 80 at conduit 78. The catalyst regeneration temperature should be at least about 600° F., and the maximum allowable temperature in the regenerator is about 1,000° F. to avoid sintering damage to the catalyst substrate. The carbon burnoff procedure in unit 80 is continued until no $CO_2$ is detected and the combustion effluent gas at 79.

The rejuvenated catalyst is removed from unit 80 at 81, undesired catalyst fines are removed in separator 82 as stream 83, and the remainder catalyst at 84 is passed to the first stage reactor 20 for reuse therein. Fresh make-up catalyst is provided at 24 in amount substantially equal to the used catalyst being discarded at 25. By utilizing an appropriate withdrawal rate for used catalyst from the second stage reactor along with rejuvenation of the used catalyst to remove contaminant metals and carbon deposits, the effective catalyst age is increased and the total catalyst consumption rate and cost are substantially reduced.

This process provides a significant improvement over conventional practice for catalytic desulfurization processes in which used catalyst may be withdrawn and fresh catalyst added to both the first and second stage reactors separately as needed to maintain desired equilibrium catalyst age and activity in each reactor. But for the present invention, used catalyst is withdrawn from the second stage reactor at a rate sufficient to maintain a specific catalyst age range therein, and is replaced with an equivalent amount of fresh catalyst added to the second stage reactor. The used catalyst withdrawal rate from the second stage reactor is sufficient to maintain the catalyst equilibrium age therein in the range of 0.3–5.0 barrels of petroleum residua feed processed per pound of catalyst contained in the reactor (B/lb). This catalyst age range is appropriate for petroleum feedstocks having a range of metals contents, and for differing types of catalyst.

The used second stage particulate catalyst material is effectively rejuvenated at unit 80, such as by solvent washing to remove heavy oils followed by water washing and mild acid treatment to remove substantially all of the contaminant metals, so that the resulting rejuvenated catalyst has its physical characteristics restored to near that of fresh catalyst. A suitable catalyst rejuvenation process is disclosed by co-filed patent application entitled "Catalyst Rejuvenation Process for Removal of Metal Contaminants". The regenerated catalyst is then added to the first stage reactor at a rate sufficient to maintain the catalyst equilibrium age therein at 0.6–10.0 barrels of feed processed per pound of catalyst in the reactor, and a equivalent amount of used catalyst is withdrawn from the first stage reactor for disposal.

This invention is preferably used for hydroprocessing high metals-containing petroleum residua feedstocks containing at least about 100 wppm total metals and usually 300–1,000 wppm total metals content. Catalyst age for the second stage reactor for these feedstocks is preferably 0.6–3.0 bbl feed/lb catalyst contained therein. At this catalyst age, the second-stage reactor will usually contain 10–20 wt. % (fresh catalyst basis) of contaminant metals, and will usually have very significant loss of catalytic activity due to loss of catalyst surface area, average pore size and total pore volume. Usual characteristic percentages for the used and rejuvenated catalysts relative to those for fresh catalyst are shown by the following Table 1.

TABLE 1

Relative Characteristics of Catalyst

| Catalyst Characteristic | Fresh Catalyst | Used 2nd Stage Catalyst | Rejuvenated Catalyst |
|---|---|---|---|
| Surface Area, % | 100 | 70–90 | 85 min. |
| Pore Volume, % | 100 | 50–70 | 85 min. |
| Avg. Pore Diameter, % | 100 | 70–90 | 85 min. |
| Total Contaminant Metals Content, wt. %* | 0 | 10–20 | 10 max. |
| Coke Deposits, wt. %* | 0 | 1O–30 | 2 max. |
| Catalytic Activity, % | 100 | 20–40 | 85 min. |

*Contaminant metals and coke expressed as weight percent of total fresh catalyst material.

However, after the used catalyst removed from the second stage reactor is treated to remove the heavy process oil coating, contaminant metals and coke deposits using suitable catalyst rejuvenation procedures, such catalyst rejuvenation substantially restores the catalyst to its original physical properties and activity. Such catalyst rejuvenation removes a significant portion of the contaminant metals and most of the coke which has been deposited on the used catalyst. Complete removal of the contaminant metals requires excessive acid leaching of the catalyst, which results in significant loss of desirable physical characteristics, i.e. surface area, pore volume, and average pore diameter of the catalyst. The removal of contaminant metals deposit from the used catalyst should be in the range of 10–50% and preferably 25–40% removal of contaminant metals. The resulting catalyst characteristics of surface area, pore volume and average pore diameter for the rejuvenated catalyst should be within about 15% of those of fresh catalyst.

The rejuvenated catalyst from the second stage reactor 30 is cascaded forward and added to the first stage reactor 20. A small amount of fresh catalyst (up to 10% of the normal addition rate) is usually also added to the first stage reactor at 24 to make up for any losses that usually occur in the catalyst handling and rejuvenation procedures. All of the used catalyst withdrawn from the first stage reactor at catalyst age of 0.6–10.0 bbl/feed/lb catalyst is disposed.

This invention will be further described with the aid of the following Example, which should not be construed as limiting the scope of the invention.

EXAMPLE 1

Comparative catalyst activity tests were performed on Maya/Isthmus petroleum feedstock having the following characteristics:

| | |
|---|---|
| API Gravity | 4.5 |
| Sulfur, Wt. % | 4.23 |
| Conradson Carbon residue, wt. % | 27.8 |
| Nickel, W ppm | 91 |
| Vanadium, W ppm | 475 |

A 15-day activity test for the catalyst was performed in a two-stage Robinson-Mahoney experimental reactor system at test conditions as follows:

| Condition No. | 1 | 2 |
|---|---|---|
| Test duration, days | 1–5 | 6–15 |
| Reactor Temp., °F. | 760 | 780 |
| Reactor Inlet $H_2PP$, psia | 2,300 | 2,300 |
| Catalyst/Reactor Volume, cc | 128 | 128 |
| Feed Rate, g/hr | 155 | 155 |

The comparative activity tests were performed using catalysts charged to the two reactors as follows:

| Catalyst Charged to | Test No. | |
|---|---|---|
| Reactors: | 1 | 2 |
| First Stage Reactor | | |
| Fresh, vol. % | 100 | 10 |
| Rejuvenated, vol. % | 0 | 90 |
| Total | 100 | 100 |
| Second Stage Reactor | | |
| Fresh, vol. % | 100 | 100 |
| Rejuvenated, vol. % | 0 | 0 |
| Total | 100 | 100 |

The fresh catalyst used was identified as Criterion HDS-2443B, which is a high hydrodesulfurization activity Ni/Mo alumina extrudate catalyst. The properties of the fresh, used and rejuvenated catalysts, each having relative characteristics expressed as a percentage of that of the fresh or used catalyst, were as follows:

TABLE 2

Relative Characteristics of Catalysts, %

| Catalyst | Fresh | Used Second Stage | Rejuvenated |
|---|---|---|---|
| Surface Area, % | 100 | 82 | 92 |
| Pore Volume, % | 100 | 61 | 100 |
| Avg. Pore Diameter, % | 100 | 88 | 101 |
| Total Contaminant Metals, W %* | 0 | 13 | 8 |
| Coke Deposits, W %* | 0 | 16 | <1 |
| Catalytic HDS Activity, % | 100 | 40 | 92 |

*Based on fresh catalyst material.

For simplicity, the catalyst properties shown above in Table 2 are normalized to a fresh catalyst basis, based on the measured levels of active molybdenum metal on the catalyst. The values are also referenced to an appropriate base, with the fresh catalyst being the base for physical properties (surface area, pore volume and average pore diameter) and the used catalyst being the base for contaminants (coke, sulfur, nickel and vanadium). The used catalyst was obtained from the second stage ebullated bed reactor used in the experimental scale hydroconversion reaction operations on the same feedstock at similar operating conditions. The catalyst age of the second stage catalyst at the end of these operations was 2.8 barrels of oil processed per lb of catalyst in the reactor. Processing of the used catalyst via catalyst rejuvenation returned the properties of the used catalyst to levels close to that of the fresh catalyst. The catalyst was rejuvenated using procedures similar to those described in co-pending patent application Ser. No. 08/853,393 filed May 9, 1997.

FIGS. 2–5 show specific catalyst activity performance results as a function of catalyst age for fresh catalyst and simulation of catalyst rejuvenation and cascading for the petroleum residua feedstock. These results clearly show that the catalyst rejuvenation and forward cascading of the rejuvenated catalyst to the first stage reactor achieved essentially the same levels of catalyst activity and selectivity for percent hydrodesulfurization in FIG. 2, vanadium metal removal in FIG. 3, hydroconversion of 975° $F.^+$ residue fraction in FIG. 4, and hydroconversion of Conradson carbon residue in FIG. 5 as compared to use of all fresh catalyst. These catalyst activity levels were achieved with a 45% overall reduction in the fresh catalyst usage.

Although this invention has been described broadly and also in terms of a preferred embodiment, it will be understood that modifications and variations can be made all within the scope as defined by the claims.

We claim:

1. A process for catalytic multi-stage hydrodesulfurization of metals-containing petroleum residua feedstocks containing at least about 2 wt. % sulfur and 100 wppm total metals, and for which fresh catalyst consumption is minimized, the process comprising:

(a) feeding a metals-containing petroleum residua feedstock together with hydrogen into a first stage reactor containing an ebullated bed of particulate catalyst, said reactor being maintained at 650–850° F. (343–455° C.) temperature, 1,000–3,500 psig hydrogen partial pressure and liquid space velocity of 0.2–2.0 $V/hr/V_r$ for providing partial hydroconversion and hydrodesulfurization reactions therein;

(b) further reacting the feedstock in a second stage reactor containing an ebullated bed of particulate catalyst, said second stage reactor being maintained at 650–850° F. temperature, 1,000–3,500 psig hydrogen partial pressure, and liquid space velocity of 0.2–2.0 $V/hr/V_r$ for further hydrodesulfurization reactions therein to achieve overall 80–95 wt. % desulfurization of the feedstock;

(c) withdrawing from said second stage reactor used particulate catalyst having equilibrium age of 0.3–5.0 bbl oil feed/lb catalyst contained in the reactor and replacing the catalyst withdrawn with an equivalent amount of fresh particulate catalyst added to the second stage reactor;

(d) rejuvenating the used catalyst withdrawn from said second stage reactor so as to remove at least about 10 wt. % of contaminant metals and at least about 80% of the carbon deposited on the used catalyst;

(e) adding the rejuvenated catalyst from said second stage catalytic reactor to said first stage catalytic reactor, and withdrawing an equivalent amount of used catalyst from the first stage reactor so as to maintain an equilibrium catalyst age therein exceeding that in the second stage reactor; and (f) withdrawing a desulfurized effluent material from said second stage reactor, phase separating the effluent material into gas and liquid fractions, and distilling the liquid fraction to produce a desulfurized medium boiling liquid product, and a heavy distillation bottoms fraction material.

2. The petroleum desulfurization process of claim 1, wherein the feedstream contains 100–1,600 wppm metals and 2–6 wt. % sulfur.

3. The petroleum desulfurization process of claim 1, wherein the particulate fresh catalyst in each reactor contain 2–25 wt. % total active metals selected from the group consisting of cadmium, chromium, cobalt, iron, molybdenum, nickel, tin, tungsten and combinations thereof deposited on a support material selected from the group of alumina, silica, titania and combinations thereof.

4. The petroleum desulfurization process of claim 1, wherein the first stage reactor conditions are 750–830° F. temperature, 1,500–3,000 psig hydrogen partial pressure, and 0.4–1.5 $V_f$/hr/$V_r$ space velocity.

5. The petroleum desulfurization process of claim 1, wherein the catalyst equilibrium age in said first stage reactor is 0.6–10 bbl oil processed per pound of catalyst contained therein.

6. The petroleum desulfurization process of claim 1, wherein the catalyst equilibrium age in the second stage reactor is maintained at 0.6–3.0 barrels oil processed per pound of catalyst contained therein.

7. The petroleum desulfurization process of claim 1, wherein the catalyst age in said first stage reactor is maintained at 1.0–6.0 barrels oil processed per pound of catalyst contained therein.

8. The petroleum desulfurization process of claim 1, wherein the used catalyst withdrawn from said second stage reactor is rejuvenated to remove contaminant metals and carbon sufficiently, so that the total contaminant metals content for the rejuvenated catalyst does not exceed about 10 wt. % of that of fresh catalyst, and the overall catalyst activity for the rejuvenated catalyst is at least 85% of that of fresh catalyst.

9. The petroleum desulfurization process of claim 8, wherein the rejuvenated catalyst has carbon content not exceeding about 2 wt. %.

10. A process for catalytic multi-stage hydrodesulfurization of metals-containing petroleum residua feedstocks containing at least about 2 wt. % sulfur and 100 wppm total metals, and for which fresh catalyst consumption is minimized, the process comprising:

(a) feeding a metals-containing petroleum residua feedstock together with hydrogen into a first stage reactor containing an ebullated bed of particulate catalyst, said reactor being maintained at 750–830° F. temperature and 1,500–3,000 psig hydrogen partial pressure and liquid space velocity of 0.40–1.5 $V_r$/hr/$V_r$ for providing partial hydroconversion and hydrodesulfurization reactions therein;

(b) further reacting the feedstock in a second stage reactor containing an ebullated bed of particulate catalyst, said second stage reactor being maintained at 750–840° F. temperature, and 2,000–3,000 psig hydrogen partial pressure, and liquid space velocity of 0.30–1.50 $V_r$/hr/$V_r$ for further hydrodesulfurization reactions therein to achieve overall 80–95 wt. % desulfurization of the feedstock;

(c) withdrawing from said second stage reactor used catalyst having equilibrium age of 0.6–3.0 bbl oil feed/lb catalyst contained in the reactor and replacing it with an equivalent amount of fresh particulate catalyst added to the second stage reactor;

(d) rejuvenating the used catalyst withdrawn from said second stage reactor so as to remove at least about 25 wt. % of contaminant metals and 90% of carbon deposited on the used catalyst;

(e) adding the rejuvenated catalyst from said second stage catalytic reactor to said first stage catalytic reactor, and withdrawing an equivalent amount of used catalyst from the first stage reactor so as to maintain an equilibrium catalyst age therein of 1.0–6.0 bbl oil/pound catalyst contained therein; and (f) withdrawing a desulfurized effluent material from said second stage reactor, phase separating the effluent material into separate gas and liquid fractions, and distilling the liquid fraction to produce a desulfurized medium boiling liquid product, and a bottoms fraction material.

* * * * *